US008864635B1

(12) United States Patent
Atwood et al.

(10) Patent No.: US 8,864,635 B1
(45) Date of Patent: Oct. 21, 2014

(54) RESISTANCE TRAINING EXERCISE APPARATUS

(75) Inventors: Lee M. Atwood, Andover, MN (US); Westin W. Nelson, Dayton, MN (US); John R. Lindemeier, Zimmerman, MN (US)

(73) Assignee: Brunswick Corporation, Lake Forest, IL (US)

( * ) Notice: Subject to any disclaimer, the term of this patent is extended or adjusted under 35 U.S.C. 154(b) by 246 days.

(21) Appl. No.: 12/899,704

(22) Filed: Oct. 7, 2010

(51) Int. Cl.
*A63B 21/062* (2006.01)
*A63B 21/00* (2006.01)

(52) U.S. Cl.
USPC ..... 482/100; 482/98; 482/99; 482/92

(58) Field of Classification Search
USPC ..... 482/92–94, 100, 102, 111, 112, 116, 482/121, 126, 129, 133, 148, 97–98, 482/135–139
See application file for complete search history.

(56) References Cited

U.S. PATENT DOCUMENTS 4,600,188 A * 7/1986 Bangerter et al. ..... 482/79
4,844,456 A * 7/1989 Habing et al. ..... 482/100
5,120,289 A * 6/1992 Yu ..... 482/137
5,997,447 A * 12/1999 Giannelli et al. ..... 482/100
6,015,369 A * 1/2000 Rasmussen ..... 482/96
2007/0149367 A1* 6/2007 Thulin ..... 482/100
2007/0161470 A1* 7/2007 Berryman ..... 482/94
2007/0232462 A1* 10/2007 Webber et al. ..... 482/93
2008/0026919 A1* 1/2008 Lundquist et al. ..... 482/100

OTHER PUBLICATIONS

Multi-Press: Life Fitness: Commercial, http://us.commercial.lifefitness.com, Aug. 11, 2010.
Body-Solid—Pro Dual Multi Press Machine, http://www.bodysolid.com, Aug. 11, 2010, pp. 1-3.
Body-Solid—Pro Dual Multi Press Machine, http://www.bodysolid.com, Owner's Manual, Aug. 11, 2010.
Powertec Workbench Multi Press WB-MP, http://www.homegymcentral.com, Sep. 8, 2010.

* cited by examiner

*Primary Examiner* — Loan H Thanh
*Assistant Examiner* — Shila Jalalzadeh Abyan
(74) *Attorney, Agent, or Firm* — Andrus Intellectual Property Law, LLP

(57) ABSTRACT

Resistance training exercise apparatus includes a boom arm pivotally mounted to a frame and having an anchor segment pivoting along a first arc about a first pivot point on the frame. A press arm is coupled to a resistance mechanism and is pivotally mounted to the anchor segment of the boom arm and pivots along a second arc about a second pivot point. The user may adjustably vary the location of the second pivot point of the press arm relative to the frame by pivoting the boom arm about the first pivot point.

23 Claims, 4 Drawing Sheets

RESISTANCE TRAINING EXERCISE APPARATUS

BACKGROUND AND SUMMARY

The invention relates to resistance training exercise apparatus, including press arm resistance training exercise apparatus.

Resistance training exercise apparatus, including press arm resistance training exercise apparatus, are known in the prior art. In one form of the latter, a user sits on a seat and against a backrest supported on a frame and engages a press arm and moves it back and forth in pivotal movement about a pivot point in an exercise routine resisted by a resistance mechanism.

The present invention arose during continuing development efforts in the above technology.

DETAILED DESCRIPTION

Figure 1:
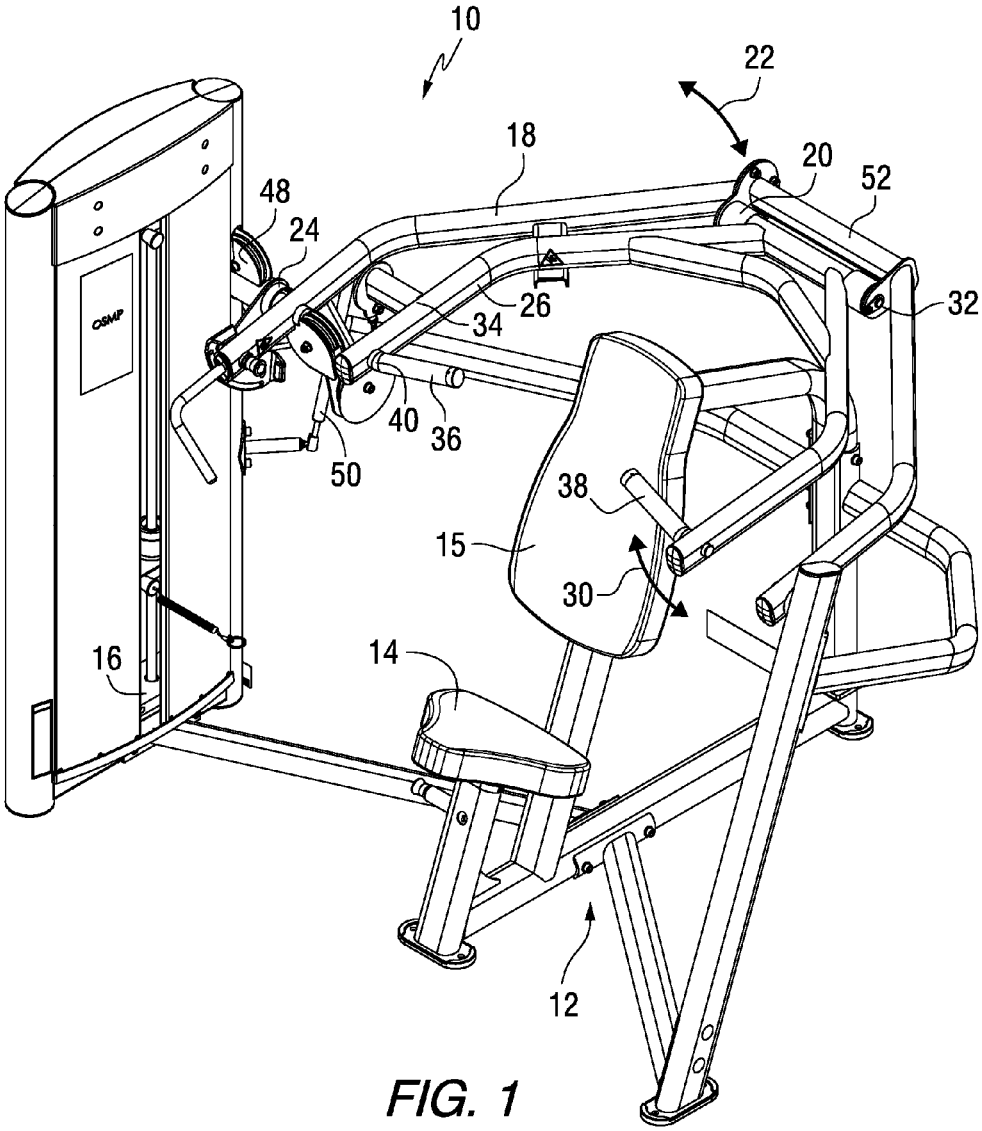
FIG. 1 is an isometric view of resistance training exercise apparatus in accordance with the invention.
Figure 2:
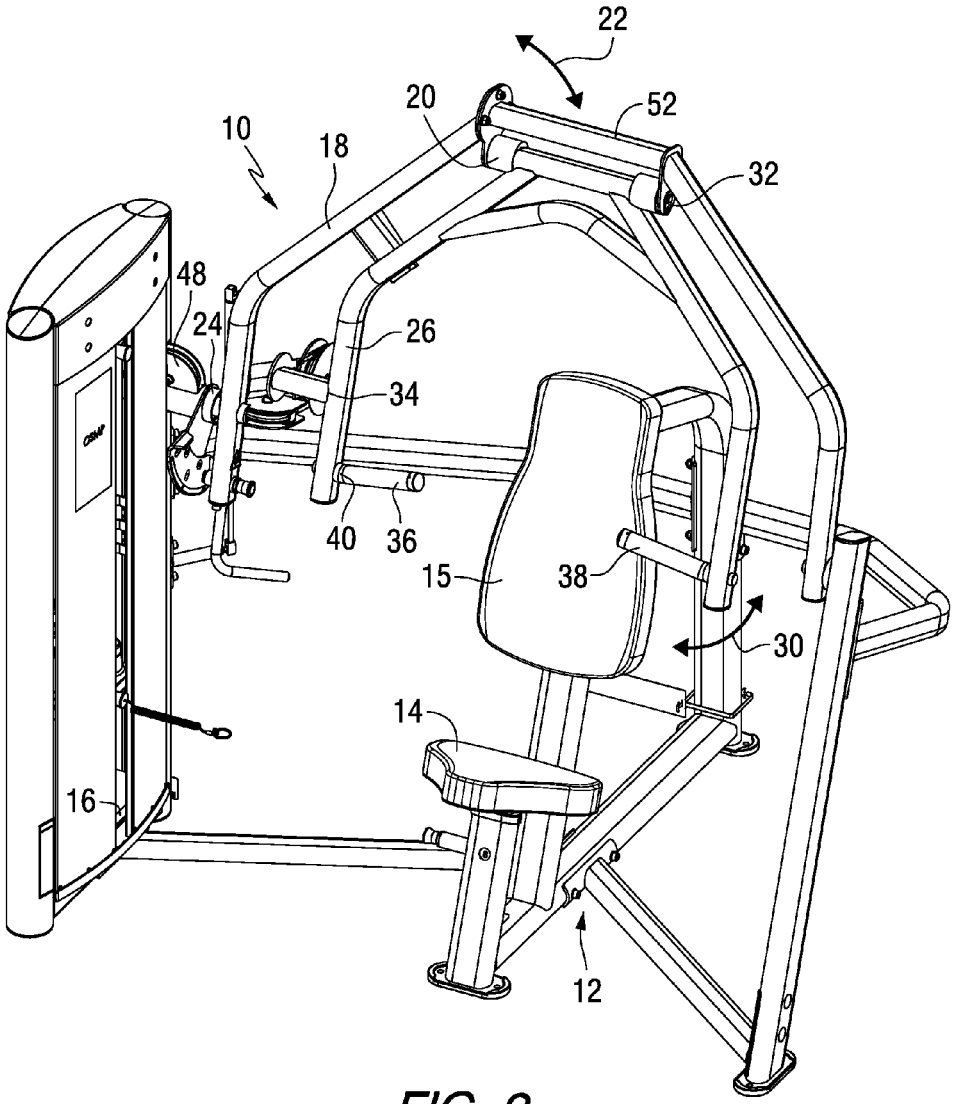
FIG. 2 is another isometric view of the apparatus of FIG. 1, in a different exercise position.
Figure 3:
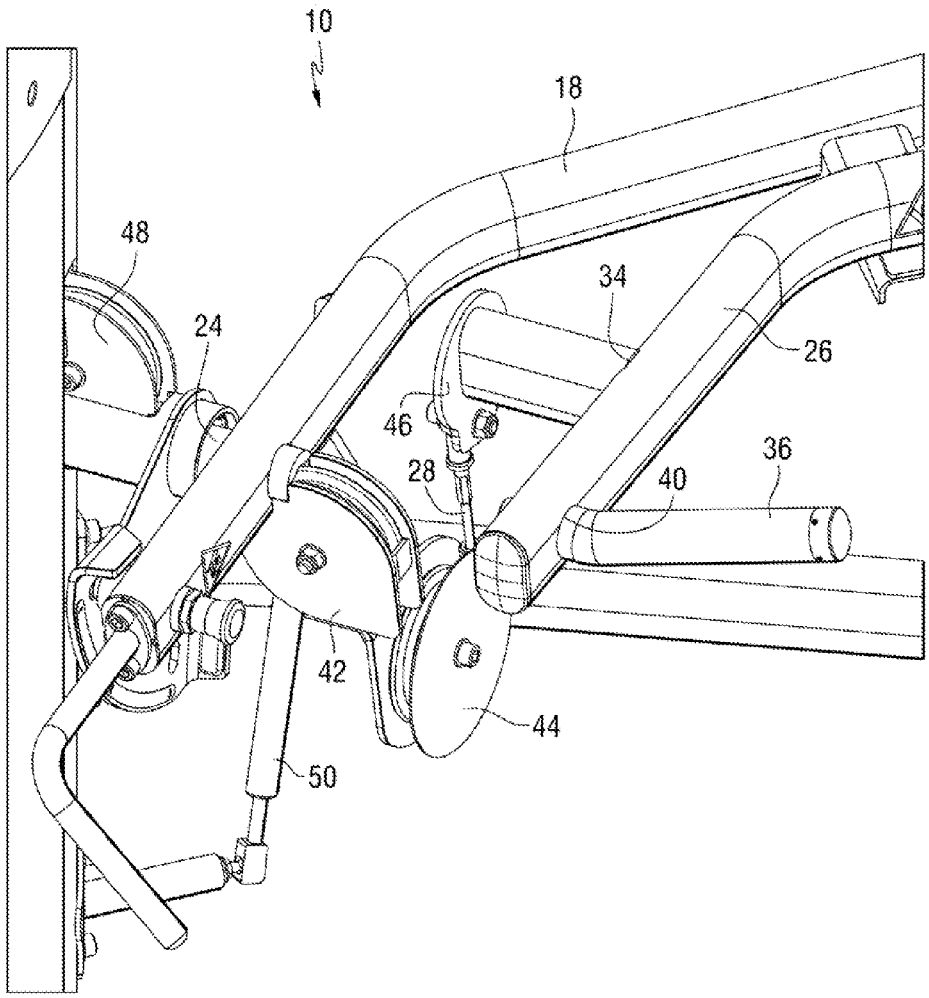
FIG. 3 is an enlarged view of a portion of FIG. 1.
Figure 4:
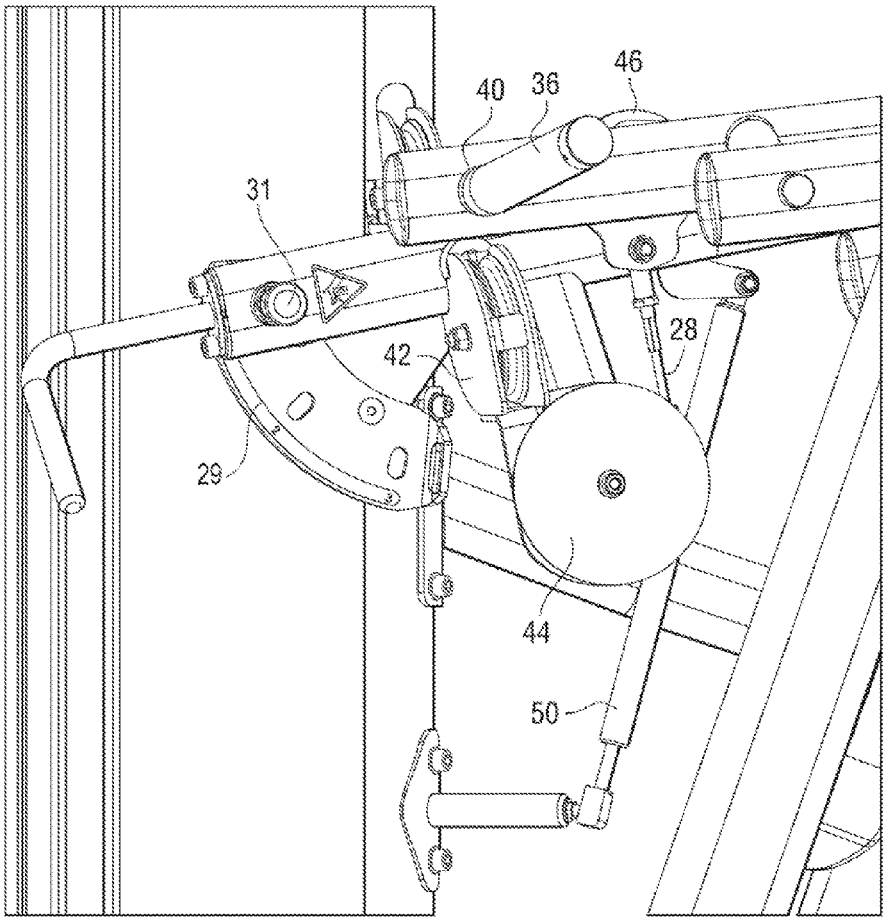
FIG. 4 is a view of the apparatus of FIG. 3 from a different angle.

FIGS. 1, 2. show resistance training exercise apparatus 10 including a frame 12, a user support including a seat 14 and/or a backrest 15 mounted to the frame for supporting a user, and a resistance mechanism 16 mounted to the frame, for example a weight stack as is known. A first pivot arm is provided by a boom arm 18 pivotally mounted to the frame. Boom arm 18 has an anchor segment 20 pivoting along a first arc 22 about a first pivot point 24. Pivot point 24 is on the frame. A second pivot arm is provided by a press arm 26 coupled to resistance mechanism 16 by cable 28, FIGS. 3, 4, and pivotally mounted to anchor segment 20 of boom arm 18 and pivoting along a second arc 30 about a second pivot point 32. Pivot point 32 is at anchor segment 20 of boom arm 18 and is movable therewith along first arc 22 upon pivoting of boom arm 18 about first pivot point 24. The user may adjustably vary the location of second pivot point 32 of press arm 26 relative to flame 12 by pivoting boom atm 18 about first pivot point 24. In one embodiment, boom arm 18 is initially adjustable by the user to a selected pivoted position about first pivot point 24 relative to the frame to select a desired position of second pivot point 32 and the angle of press arm 26 relative to the user supported by seat 14 and backrest 15, whereafter the user engages press arm 26 and moves it back and forth in pivotal movement about second pivot point 32 in an exercise routine. As shown in FIGS. 3 and 4, the selected pivoted position of the boom arm 18 along the first arc 22 can be selectively fixed by a conventional bracket 29 and pin 31 connection. The pivoting of boom arm 18 about first pivot point 24 changes the location of second pivot point 32 of press arm 26 relative to the user supported on seat 14 and against backrest 15, without having to change the position of seat 14 and without having to change the position of backrest 15.

Resistance mechanism 16 is coupled via cable 28 to press arm 26 at a first location 34 spaced from second pivot point 32. Press arm 26 has one or more grips 36, 38 at a second location 40 spaced from second pivot point 32 and grippable by the user. In one embodiment, first and second locations 34 and 40 are at different positions along press arm 26. First location 34 is spaced from second pivot point 32 by a first distance. Second location 40 is spaced from second pivot point 32 by a second distance. In one embodiment, the noted second distance is greater than the noted first distance. In another embodiment, the noted second distance is equal to the noted first distance. In another embodiment, the noted second distance is less than the noted first distance.

Boom arm 18 pivots about a first pivot axis extending through first pivot point 24 on the frame. Second pivot point 32 is coupled to resistance mechanism 16 by the noted cable 28 extending along the noted first pivot axis through first pivot point 24. As shown in FIGS. 1 and 2, the second pivot point 32 is located vertically higher than the first pivot point 24 relative to the user support throughout travel of the second pivot point 32 along the first, arc 22. Cable 28 is trained around one or more pulleys 42, 44 and attached to press arm 26 at a cable attachment point 46 spaced from second pivot point 32. Pulleys 42, 44 are mounted to boom arm 18 and pivot therewith about first pivot point 24. Pulleys 42, 44 each mounted to boom arm 18 enable resisted movement of press arm 26 relative to boom arm 18 without changing the length of cable 28. One or more pulleys such as 48 may be mounted to the frame to guide the cable for attachment to the weight stack 16, as is known. A second resistance mechanism, which in one embodiment may be a gas cylinder 50, is coupled to boom arm 18, e.g. mounted between the frame and the boom arm, and aids adjustment pivoting of boom arm 18 by the user to a desired position. Boom arm 18 has a distal end 52 distally opposite first pivot point 24. In one embodiment, anchor segment 20 is adjacent distal end 52.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A resistance training exercise apparatus comprising:

a frame;

user support on said frame for supporting a user;

a resistance mechanism;

an elongated first pivot arm that has opposite ends that are pivotally coupled to said frame, said first pivot arm having an anchor segment that is located between the opposite ends, wherein the first pivot arm is configured to pivot along a first arc about a first pivot point, said first pivot point being on said frame;

a second pivot arm that is coupled to said resistance mechanism and is pivotally coupled to said anchor segment of said first pivot arm and is configured to pivot back and forth along a second arc about a second pivot point, said second pivot point being at said anchor segment of said first pivot arm and being movable therewith along said first arc upon pivoting of said first pivot atm about said first pivot point, wherein the location of said second pivot point of said second pivot arm is adjustably variable relative to said frame by pivoting said first pivot arm about said first pivot point, wherein said resistance mechanism is coupled to said second pivot arm by a coupler having a first end connected to said resistance mechanism and a second end connected to said second pivot arm, such that said resistance mechanism is coupled to said second pivot arm independently of said first pivot arm and resists movement of said second pivot arm about said second pivot point, wherein said first and second pivot points define first and second pivot axes that are parallel to each other, wherein said first arc along which said second pivot point pivots back and forth is oriented towards the user support; and wherein said first arc is oppositely oriented with respect to said second arc.

2. The resistance training exercise apparatus according to claim 1 wherein said first arc is curved towards said second arc and said second arc is curved towards said first arc.

3. The resistance training exercise apparatus according to claim 2 wherein said pivoting of said first pivot arm about said first pivot point changes the location of said second pivot point of said second pivot arm relative to the user supported by said user support, without changing the position of said user support.

4. The resistance training exercise apparatus according to claim 3 wherein said user support comprises a seat.

5. The resistance training exercise apparatus according to claim 3 wherein said user support comprises a backrest.

6. The resistance training exercise apparatus according to claim 3 wherein said user support comprises a seat and a backrest.

7. The resistance training exercise apparatus according to claim 1 wherein:

said resistance mechanism is coupled to said second pivot arm at a first location spaced from said second pivot point; and said second pivot arm has a grip at a second location spaced from said second pivot point and grippable by the user.

8. The resistance training exercise apparatus according to claim 7 wherein said first and second locations are at different positions along said second pivot arm, said second pivot aim extends along an extension span from said anchor segment to said second location, and said first location is between said anchor segment and said second location along said extension span such that said second end of said coupler is connected to said second pivot arm along said extension span at said first location between said anchor segment and said second location.

9. The resistance training exercise apparatus according to claim 8 wherein:

said first location is spaced from said second pivot point by a first distance;

said second location is spaced from said second pivot point by a second distance; and said second distance is greater than said first distance.

10. The resistance training exercise apparatus according to claim 1 wherein:

said first pivot arm pivots about a first pivot axis extending through said first pivot point on said frame; and said second pivot arm is coupled to said resistance mechanism by a cable extending along said first pivot axis.

11. The resistance training exercise apparatus according to claim 10 wherein:

said cable is trained around one or more pulleys and attached to said second pivot arm at a cable attachment point spaced from said second pivot point; and said one or more pulleys are coupled to said first pivot arm and pivot therewith about said first pivot point.

12. The resistance training exercise apparatus according to claim 11 comprising two said pulleys each coupled to said first pivot arm and enabling resisted movement of said second pivot arm relative to said first pivot arm without changing the length of said cable.

13. The resistance training exercise apparatus according to claim 1 wherein said resistance mechanism is a first resistance mechanism and is coupled to said second pivot arm and provides resistance during exercise, and comprising a second resistance mechanism coupled to said first pivot arm and aiding adjustment pivoting of said first pivot arm by the user to said desired position.

14. The resistance training exercise apparatus according to claim 1 wherein:

said first pivot arm has a distal end distally opposite said first pivot point; and said anchor segment is adjacent said distal end.

15. The resistance training exercise apparatus according to claim 1 wherein said first pivot arm is a boom arm, said second pivot arm is a press arm, and said resistance training exercise apparatus is a press arm resistance training exercise apparatus.

16. A resistance training exercise apparatus comprising:

a frame;

a user support coupled to said frame for supporting a user;

a resistance mechanism;

an elongated first pivot arm that has opposite ends that are pivotally coupled to said frame, said first pivot arm having an anchor segment that is located between the opposite ends, wherein the first pivot arm is configured to pivot along a first arc about a first pivot point, said first pivot point being on said frame;

an elongated second pivot arm that has opposite ends; where in the second pivot arm is coupled to said resistance mechanism and is pivotally coupled to said anchor segment of said first pivot arm and is configured to pivot back and forth along a second arc about a second pivot point, said second pivot point being at said anchor segment of said first pivot arm and being movable therewith along said first arc upon pivoting of said first pivot arm about said first pivot point wherein the location of said second pivot point of said second pivot arm is adjustably variable relative to said frame by pivoting said first pivot arm about said first pivot point, wherein said resistance mechanism is coupled to said second pivot arm by a coupler having a first end connected to said resistance mechanism and a second end connected to said second pivot arm, such that said resistance mechanism is coupled to said second pivot arm independently of said first pivot arm and resists movement of said second pivot arm about said second pivot point, wherein said first and second pivot points define first and second pivot axes which are parallel to each other, and wherein said second pivot point is located vertically higher than said first pivot point relative to said user support throughout travel of said second pivot point along said first arc.

17. A resistance training exercise apparatus comprising:

a frame;

a user support that is mounted to the frame and support a user;

an elongated first pivot arm that extends between opposing ends that are both pivotably mounted to the frame along a first pivot axis; wherein the first pivot arm is pivotable back and forth about the first pivot axis along a first arc that is curved towards the user support;

an anchor segment located between the opposing ends of the first pivot arm;

a second pivot arm that is pivotably mounted to the first pivot arm at the anchor segment, the second pivot arm being pivotable with respect to the first pivot arm about a second pivot axis that extends through the anchor segment and parallel to the first pivot axis, wherein the second pivot arm pivots back and forth about the second pivot axis along a second arc that is curved away from the user support, oppositely relative to the first arc; and a resistance mechanism that is coupled to the second pivot arm and that resists pivoting movement of the second pivot arm about the second pivot axis and with respect to the first pivot arm, wherein the second pivot arm comprises opposing ends and wherein the second pivot arm is attached to the first pivot arm at a location between the opposing ends of the second pivot arm, and wherein the location of said second pivot axis of said second pivot arm is adjustably variable relative to said frame by pivoting said first pivot arm about said first pivot axis.

18. The resistance training exercise apparatus according to claim 17, wherein the resistance mechanism is attached to the second pivot arm by a cable.

19. The resistance training exercise apparatus according to claim 18, comprising handles on the opposing ends of the second pivot arm.

20. The resistance training exercise apparatus according to claim 19, wherein the cable is attached to the second pivot arm at a location between the handles.

21. The resistance training exercise apparatus according to claim 17, comprising a device for fixing the first pivot arm at a location along the first arc.

22. The resistance training exercise apparatus according to claim 21, wherein the device comprises a bracket and pin.

23. The resistance training exercise apparatus according to claim 17, wherein the second pivot axis is located vertically higher than the first pivot axis such that the second pivot axis is located farther from the user support than the first pivot axis.

* * * * *

UNITED STATES PATENT AND TRADEMARK OFFICE

CERTIFICATE OF CORRECTION

PATENT NO. : 8,864,635 B1
APPLICATION NO. : 12/899704
DATED : October 21, 2014
INVENTOR(S) : Lee M. Atwood, Westin W. Nelson and John R. Lindemeier It is certified that error appears in the above-identified patent and that said Letters Patent is hereby corrected as shown below:

In the Claims

In Claim 1, Column 2, Line 63: “atm” should instead read --arm--.

Signed and Sealed this
Twenty-eighth Day of April, 2015

Michelle K. Lee

Michelle K. Lee
*Director of the United States Patent and Trademark Office*